United States Patent [19]

Harnish

[11] 4,030,315

[45] June 21, 1977

[54] REVERSE CYCLE HEAT PUMP

[75] Inventor: James R. Harnish, York, Pa.

[73] Assignee: Borg-Warner Corporation, Chicago, Ill.

[22] Filed: Sept. 2, 1975

[21] Appl. No.: 609,322

[52] U.S. Cl. ..... 62/324; 62/472; 62/503; 62/513

[51] Int. Cl.[2] ..... F25B 13/00

[58] Field of Search ..... 62/83, 84, 113, 149, 62/174, 324, 472, 503, 513

[56] References Cited

UNITED STATES PATENTS

| | | | |
|---|---|---|---|
| 2,977,773 | 4/1961 | DeKanter | 62/149 |
| 3,077,086 | 2/1963 | Japhet | 62/324 |
| 3,078,689 | 2/1963 | Japhet | 62/324 |
| 3,246,482 | 4/1966 | Harnish | 62/324 |
| 3,324,671 | 6/1967 | Harnish | 62/174 |
| 3,350,898 | 11/1967 | Harnish | 62/324 X |
| 3,423,954 | 1/1969 | Harnish et al. | 62/324 X |

*Primary Examiner*—William F. O'Dea
*Assistant Examiner*—Ronald C. Capossela
*Attorney, Agent, or Firm*—Thomas B. Hunter

[57] ABSTRACT

A reverse cycle heat pump is provided with a heat exchanger which provides refrigerant subcooling with no thermodynamic losses. The heat exchanger is arranged such that it is operative only during the heating cycle to permit optimum charging of the system and allow operation during the cooling cycle with no excess refrigerant in the system accumulator. The heat exchanger is bypassed when the system is converted from heating to cooling operations.

Liquid refrigerant will be mixed with oil in the accumulator during the heating cycle, but not the cooling cycle. Then since refrigerant liquid returning with the oil from the accumulator to the compressor should be evaporated to avoid harm to the compressor, heat applied to the suction line, with no thermodynamic loss, vaporizes this refrigerant. During the cooling operation, no liquid refrigerant is returned from the accumulator, so heat added to the suction gas would be undesirable.

4 Claims, 3 Drawing Figures

REVERSE CYCLE HEAT PUMP

BACKGROUND OF THE INVENTION

1. Field of the Invention:

Reverse cycle heat pumps containing a suction line heat exchanger which is operative only during the heating cycle to re-evaporate excess liquid refrigerant carried by the lubricant as it flows to the compressor suction inlet.

2. Description of the Prior Art:

In U.S. Pat. No. 3,077,086, an oil distillation apparatus is provided for a reverse cycle heat pump. A mixture of refrigerant and oil is bled off from the discharge side of the low side refrigerant pump, said mixture being pumped through an oil still which is heated by compressor discharge gas. Since discharge gas, rather than high pressure refrigerant liquid, is used to provide heat for distillation, and the heat exchanger is utilized on both the heating and cooling cycles, the present invention is easily distinguished therefrom.

In U.S. Pat. No. 3,246,482 a heat exchanger is located between the liquid refrigerant line and the suction line; but this is operative during both the heating and cooling cylces of operation. Many similar patents are related to designs which are purposely charged with sufficient refrigerant to maintan a liquid level in the accumulator during both the heating and cooling cycles of operation. Consequently, these require heat exchange for both cycles of operation in order to evaporate liquid returning in the suction line from the accumulator.

SUMMARY OF THE INVENTION

This invention relates generally to reverse cycle heat pumps and more particularly to heat pumps which are provided with heat exchange means to effect heat transfer from the hot liquid leaving the coil operating as a condenser to the suction gas leaving the coil operating as an evaporator. This heat transfer can take place with substantially no thermodynamic loss and the refrigerant piping is such that the heat exchanger is automatically bypassed when the system is converted from heating to cooling operation. In capillary type, reverse cycle heat pumps, it was quite common in the prior art to overcharge the system so that during the heating cycle a substantial quantity of refrigerant was maintained in a suction line accumulator. This is true because the charge required for cooling operation is much greater than that which is required for heating. It was also common to provide a bleed hole in the accumulator suction tube to assure that oil would be returned to the compressor. However, the liquid refrigerant mixed with the oil results in both refrigerant and oil being returned to the compressor. Unless it is evaporated, the liquid refrigerant will flow to the compressor oil sump where it will dilute the oil, causing poor lubrication and reduced compressor service life. The present invention provides for heat exchange relation between the high pressure liquid leaving the indoor coil and the suction gas. Thus the liquid at a high pressure is subcooled while any liquid in the suction gas is evaporated at no thermodynamic loss. For cooling operation, the accumulator operates with no refrigerant liquid at normal conditions. If heat were used, the compressor would become overheated at high load conditions. This invention provides a simple, economical means for heating the suction gas only during the heating cycle and providing substantially no heating to the suction gas during the cooling cycle.

DETAILED DESCRIPTION OF THE PREFERRED EMBODIMENT

Figure 1:
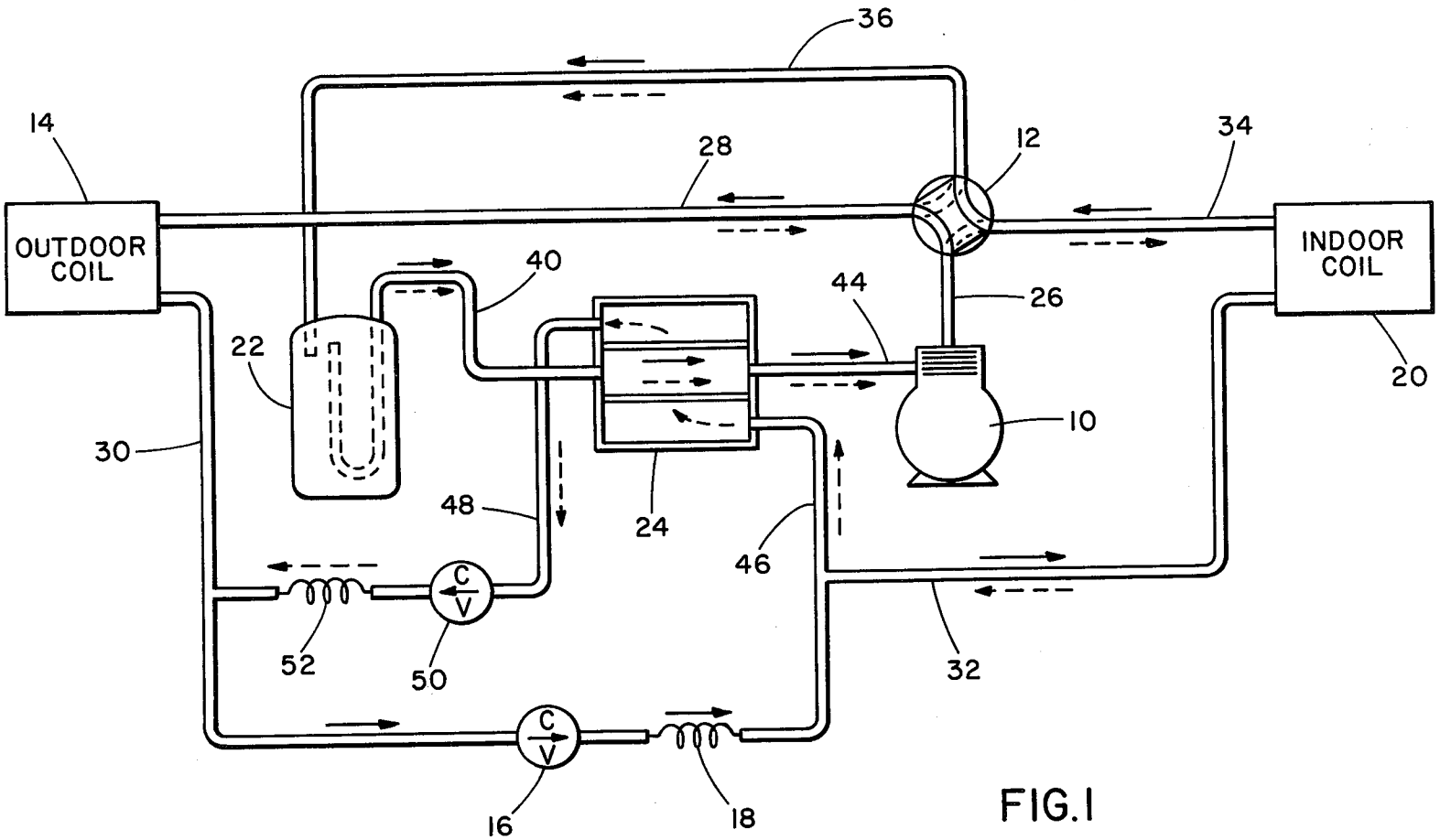
FIG. 1 is a schematic diagram of a reverse cycle heat pump system constructed in accordance with the principles of the present invention.

Referring now to FIG. 1, the system of the present invention includes a compressor 10, a reversing valve 12, an outdoor coil 14, a check valve 16, a capillary 18, an indoor coil 20, a suction line accumulator 22 and a heat exchanger 24. The arrows with solid line stems on FIG. 1 show the direction of refrigerant flow for cooling operations which may be further described as follows: refrigerant compressed in compressor 10 flows through hot gas line 26 to four way reversing valve 12 which in its solid line position causes flow from line 26 to hot gas line 28, connected to outdoor coil 14. The refrigerant condenses in coil 14 and flows through hot liquid line 30, check valve 16 and capillary 18 to low pressure liquid line 32. Refrigerant flow continues through indoor coil 20, now functioning as the evaporator, then through cold gas line 34, the other (solid-line) passage in reversing valve 12, line 36, suction line accumulator 22 and line 40 to heat exchanger 24.

The heat exchanger 24, which may be of any conventional type, e.g. shell and tube, tube soldered to tube etc., has no fluid flowing on one side so that during the cooling cycle there is no significant heat transfer of any sort as the refrigerant flows therethrough and via line 44 to the suction side of compressor 10.

During the heating cycle, valve 12 is moved to its dotted line position and refrigerant flow is indicated by the arrows having the dashed line stems. From compressor 10, refrigerant flows through line 26, through valve 12 and line 34 to the indoor coil 20 which is operating as a condenser. Flow continues through lines 32 and 46 to heat exchanger 24, where it is brought into heat exchange relation with cooled gas (and liquid refrigerant/lubricating oil) flowing back to the compressor through lines 40 and 44. The subcooled liquid from the heat exchanger then flows through line 48, which contains check valve 50 and capillary 52, to line 30. It is then directed to outdoor coil 14, operating as the evaporator, and passes through line 28, valve 12, line 36, suction line accumulator 22 and line 40 to the other side of heat exchanger 24. The liquid refrigerant entrained in the stream is evaporated by the heat from the hot liquid stream (being subcooled) and the mixture of refrigerant gas and lubricating oil is directed to the suction side of compressor 12 through line 44.

The system just described is best utilized as a packaged unit in which all components are in a self contained assembly. Typical of such installations would be window or through-the-wall units. If the system is split - that is the compressor and outdoor coil are in one package, and the evaporator in another, some modification must be made in the FIG. 1 system. The main difference is in the field installed liquid and gas lines to (and from) the inside coil.

Figure 2:
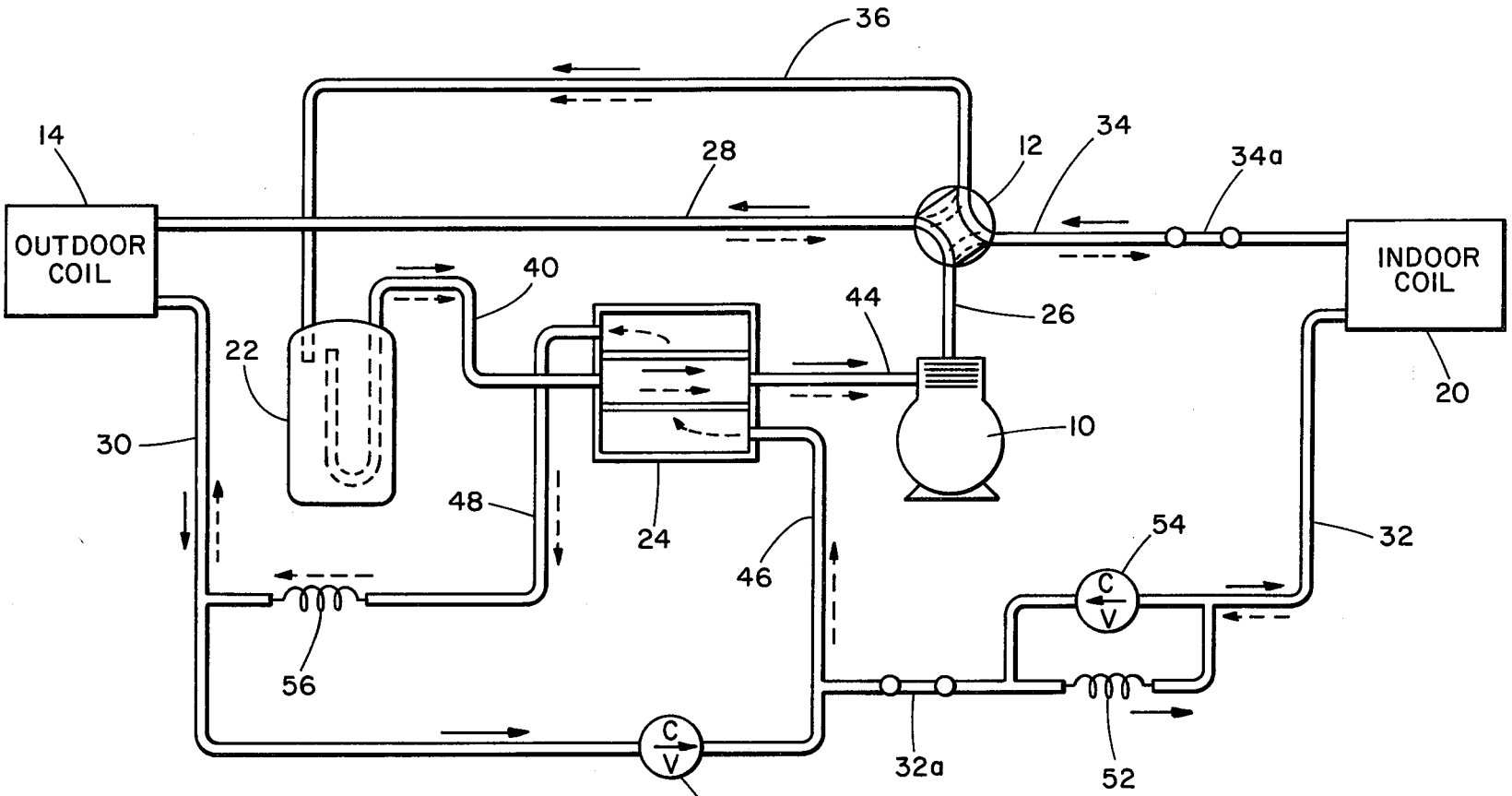
FIG. 2 is a modification of the heat pump system shown in FIG. 1.

A split system installation is shown in FIG. 2, and where the elements are the same and correspond to the packaged unit of FIG. 1, the same reference numerals are employed.

The system is quite similar to the packaged unit system of FIG. 1 except that line 34 has a field connected section 34A and line 32 has a field connected section 32A. For cooling operation refrigerant flows from compressor 10 through reversing valve 12 and line 28. From coil 14 condensed refrigerant flows through check valve 50, line 32, including field connected section 32A and capillary 52 to indoor coil 20. Refrigerant vapor then flows through line 34, including field connected section 34A, to reversing valve 12, line 36, suction accumulator 22, heat exchanger 24, and line 44 back to compressor suction.

During the heating cycle, refrigerant from compressor 10 is delivered through hot gas line 26 and reversing valve 12 (through the passages as shown in the dotted line position), and then through line 34 (34A) to indoor coil 20. From the indoor coil 20 refrigerant flows through line 32, check valve 54 (which offers less flow resistance than capillary 52), field installed section 32A, and then through line 46 to heat exchanger 24. From the heat exchanger, the subcooled refrigerant flows through line 48 through capillary 56 and line 30 to the outdoor coil 14. Refrigerant vapor then flows through line 28, reversing valve 12, line 36, to suction line accumulator 22. The suction gas returns to compressor 10 through lines 40, heat exchanger 24, and line 44.

Figure 3:
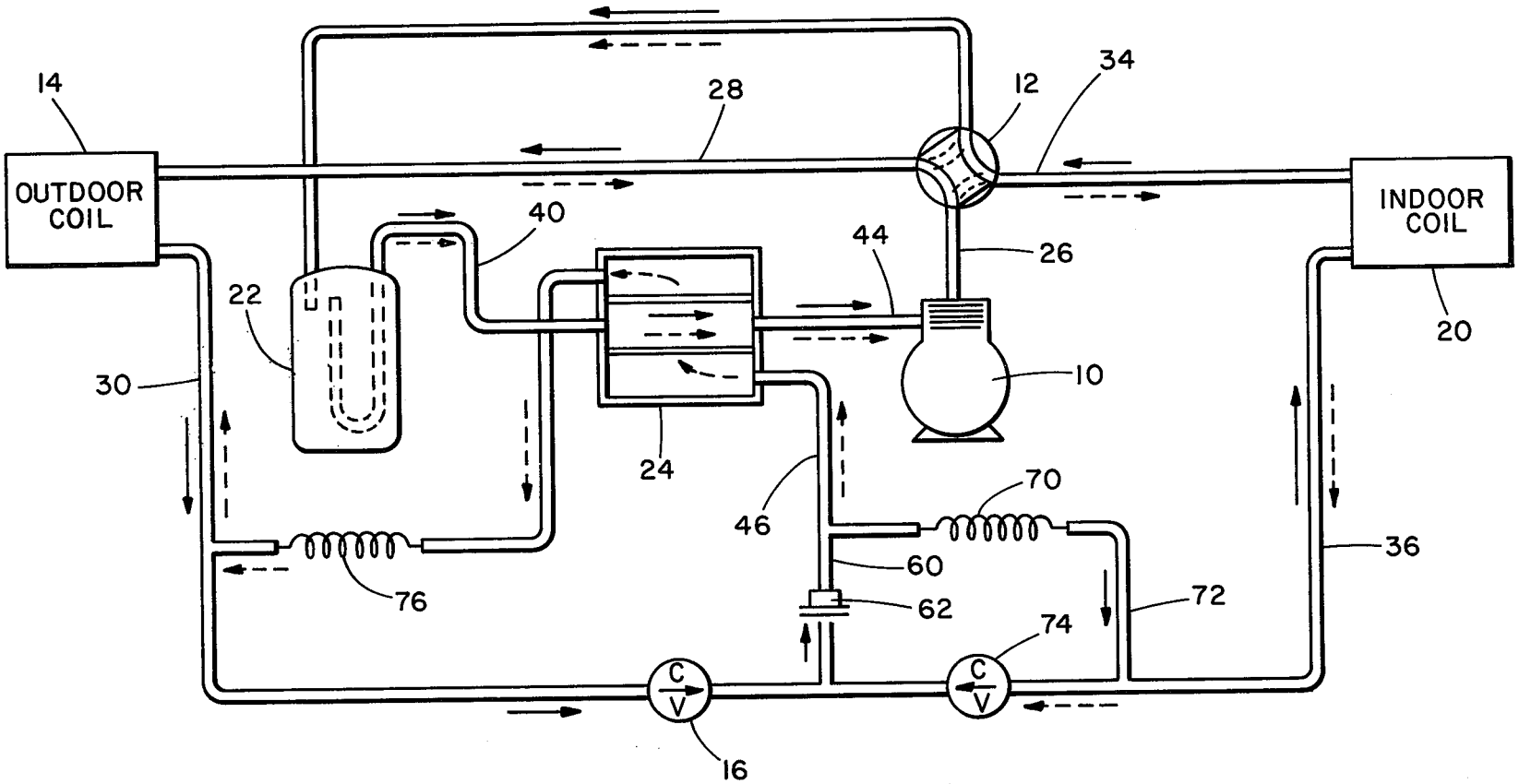
FIG. 3 is still another modification of the heat pump system shown in FIG. 1.

FIG. 3 discloses still another modification of the invention which is adapted for a packaged installation. Again, the same reference numerals are applied where the elements are common to FIG. 1 and in generally the same relationship. For the cooling cycle, refrigerant from compressor 10 passes through hot gas line 26, reversing valve 12, and line 28 to outdoor coil 14. The condensed refrigerant then flows through line 30, check valve 16, and line 60 through a filter-dryer element 62 disposed therein. From there the refrigerant flows through capillary 70, line 72, to the indoor coil 20 by a line 32. The return to compressor suction is the same as in the previous embodiments, that is, through line 34, reversing valve 12, suction line accumulator 22, line 40, heat exchanger 24, and suction gas line 44.

During heating operation, hot gas from compressor 10 flows through the hot gas line 26 and reversing valve 12 (through passages as shown in the dotted line position) and line 34 to indoor coil 20. From the indoor coil, the condensed refrigerant flows through line 32, check valve 74, line 60 (including filter-dryer 62), line 46 to heat exchanger 24. From the heat exchanger, the subcooled liquid passed through capillary 76, line 30 to outdoor coil 14. Vapor returns to compressor suction through line 28, reversing valve 12, suction line accumulator 22, line 40, heat exchanger 24, and suction gas line 44.

While this invention has been described in connection with certain specific embodiments thereof, it is to be understood that this is by way of illustration and not by way of limitation; and the scope of the appended claims should be construed as broadly as the prior art will permit.

What is claimed is:

1. In a heat pump system of the type including a compressor; a fluid reversal means; an indoor coil; an outdoor coil; first and second expansion means; means for conducting refrigerant in a first closed circuit path from said compressor through said reversal means to said outdoor coil and then through said first refrigerant expansion means to said indoor coil and back to said compressor; said reversal means being adapted to be repositioned to allow refrigerant from said compressor to flow in a second closed circuit path to said indoor coil through said second refrigerant expansion means to said outdoor coil and then back to said compressor, the improvement comprising a heat exchanger for bringing fluid returning to said compressor into heat exchange contact with high pressure liquid from said indoor coil during flow in said second closed circuit path, and means for bypassing said heat exchanger during flow in said first closed circuit path.

2. Apparatus as defined in claim 1 including a heat exchanger through which low pressure refrigerant vapor flows in returning to said compressor; a first conduit conducting hot condensed refrigerant from said indoor coil through said heat exchanger in heat exchange relation with said low pressure refrigerant vapor; and a second conduit adapted to conduct hot condensed refrigerant from said outdoor coil directly to said first expansion means.

3. Apparatus as defined in claim 2 including a suction line accumulator upstream from said compressor and said heat exchanger.

4. A heat pump system comprising: a refrigerant compressor; a reversing valve; an outdoor coil; a heat exchanger including means defining first and second independent fluid paths adapted to transfer heat therebetween; an indoor coil; a first refrigerant line connecting the discharge from said compressor to said reversing valve; a second refrigerant line connecting said reversing valve to said outdoor coil; a third refrigerant line connecting said outdoor coil to said indoor coil, said third refrigerant line having a first section thereof including a first capillary and a first check valve permitting flow through said first section only in the direction toward said indoor coil; a fourth refrigerant line connecting said indoor coil with said reversing valve; a fifth refrigerant line connecting said reversing valve to said first fluid path in said heat exchanger; a sixth refrigerant line connecting said first fluid path to the suction side of said compressor whereby, upon operation of the system in the cooling cycle, refrigerant passes from compressor discharge, in series, through said first refrigerant line, said reversing valve, said second refrigerant line, said outdoor coil, said third refrigerant line, said first check valve, said first capillary, said indoor coil, said fourth refrigerant line, said reversing valve, said fifth refrigerant line, said heat exchanger, and said sixth refrigerant line; a seventh refrigerant line connecting a second section of said third refrigerant line with said heat exchanger, through said second fluid path, for effecting heat transfer to refrigerant flowing through said first fluid path; an eighth refrigerant line connecting said second fluid path with said outdoor coil, said line including a second check valve and a second capillary whereby, upon operation of the system in the heating cycle, refrigerant passes from compressor discharge, in series, through said first refrigerant line, said reversing valve, said indoor coil, said second section of said third refrigerant line, said seventh refrigerant line, said second fluid path, said eighth refrigerant line, including said second check valve and said second capillary, said outdoor coil, said second refrigerant line, said reversing valve, said fifth refrigerant line, said first fluid path, on the opposite side to flow from said indoor coil, and said sixth refrigerant line to compressor suction.

* * * * *